US011715911B2

(12) United States Patent
Tryson et al.

(10) Patent No.: US 11,715,911 B2
(45) Date of Patent: Aug. 1, 2023

(54) CONTACT ASSEMBLY WITH GROUND STRUCTURE

(71) Applicants: TE Connectivity Services GmbH, Schaffhausen (CH); Tyco Electronics Holdings (Bermuda) No. 7 Limited, Taipei (TW)

(72) Inventors: Michael Joseph Tryson, Spring Grove, PA (US); Michael John Phillips, Camp Hill, PA (US); Dustin Grant Rowe, Harrisburg, PA (US); Asroc Chen, New Taipei (TW)

(73) Assignees: TE CONNECTIVITY SOLUTIONS GmbH, Schaffhausen (CH); TYCO ELECTRONICS HOLDINGS (BERMUDA) NO. 7 LIMITED, Hamilton (BM)

( * ) Notice: Subject to any disclaimer, the term of this patent is extended or adjusted under 35 U.S.C. 154(b) by 43 days.

(21) Appl. No.: 17/410,469

(22) Filed: Aug. 24, 2021

(65) Prior Publication Data

US 2023/0068707 A1 Mar. 2, 2023

(51) Int. Cl.

| | |
|---|---|
| ***H01R 13/6471*** | (2011.01) |
| ***H01R 12/72*** | (2011.01) |
| ***H01R 12/75*** | (2011.01) |

(52) U.S. Cl.

CPC ..... *H01R 13/6471* (2013.01); *H01R 12/721* (2013.01); *H01R 12/727* (2013.01); *H01R 12/75* (2013.01)

(58) Field of Classification Search

CPC ..... H01R 13/6471; H01R 13/6581; H01R 13/6585; H01R 13/6597; H01R 13/6596; H01R 13/6598; H01R 13/6599; H01R 13/6591; H01R 12/721; H01R 12/727; H01R 12/712; H01R 12/714; H01R 12/716; H01R 12/724; H01R 12/75; H01R 24/60; H01R 13/6473

USPC ..... 439/86, 90, 607.02, 92, 941

See application file for complete search history.

(56) References Cited

U.S. PATENT DOCUMENTS

| | | | | |
|---|---|---|---|---|
| 6,471,525 | B1 * | 10/2002 | Fan | H01R 12/52 439/70 |
| 6,786,771 | B2 | 9/2004 | Gailus | |
| 7,335,063 | B2 | 2/2008 | Cohen et al. | |
| 7,371,117 | B2 * | 5/2008 | Gailus | H01R 13/6471 439/607.08 |
| 7,811,129 | B2 * | 10/2010 | Glover | H01R 13/6599 439/607.07 |
| 8,523,583 | B2 * | 9/2013 | Ito | H01R 12/721 439/108 |

(Continued)

*Primary Examiner* — Marcus E Harcum

(57) ABSTRACT

A contact assembly for an electrical connector signal contacts arranged in pairs and ground contacts are interspersed with the pairs of the signal contacts. Each signal contact includes a signal contact body having first and second sides extending between a signal mating end and a signal terminating end. Each ground contact includes a ground contact body having first and second sides extending between a ground mating end and a ground terminating end. The contact assembly includes a ground shield assembly including a ground shield spanning across the contacts and ground connective elements electrically connected to the ground shield and the corresponding ground contacts. The ground connective elements are compressible.

22 Claims, 5 Drawing Sheets

(56) References Cited

U.S. PATENT DOCUMENTS

| | | | | |
|---|---|---|---|---|
| 9,496,657 | B1 * | 11/2016 | Chang | H01R 13/6471 |
| 9,666,998 | B1 * | 5/2017 | de Boer | H01R 13/6596 |
| 10,243,304 | B2 * | 3/2019 | Kirk | H01R 13/6599 |
| 10,403,565 | B1 * | 9/2019 | Henry | H01R 13/6596 |
| 10,476,192 | B2 * | 11/2019 | Huang | H01R 12/725 |
| 10,777,921 | B2 * | 9/2020 | Lu | H01R 12/7005 |
| 10,873,160 | B2 * | 12/2020 | Henry | H01R 12/72 |
| 10,944,189 | B2 * | 3/2021 | Xu | H01R 12/75 |
| 11,108,194 | B2 * | 8/2021 | Lin | H01R 13/6471 |
| 11,316,304 | B2 * | 4/2022 | Chen | H01R 13/6598 |
| 2012/0184140 | A1 * | 7/2012 | Davis | H01R 13/6587 439/607.34 |
| 2013/0102192 | A1 * | 4/2013 | Davis | H01R 13/6581 439/607.07 |
| 2020/0076135 | A1 * | 3/2020 | Tang | H01R 12/724 |
| 2020/0266584 | A1 * | 8/2020 | Lu | H01R 12/75 |
| 2020/0350731 | A1 * | 11/2020 | Buck | H01R 13/6471 |
| 2020/0412060 | A1 * | 12/2020 | Hsieh | H01R 13/6471 |
| 2021/0126385 | A1 * | 4/2021 | Zhang | H01R 13/6473 |
| 2021/0135389 | A1 * | 5/2021 | Jiang | H01R 13/6461 |
| 2022/0094116 | A1 * | 3/2022 | Lin | H01R 13/6581 |

* cited by examiner

CONTACT ASSEMBLY WITH GROUND STRUCTURE

BACKGROUND OF THE INVENTION

The subject matter herein relates generally to electrical connectors.

Electrical connectors are typically used to electrically couple various types of electrical devices to transmit signals between the devices. At least some known electrical connectors include a card edge connector having contacts arranged in one or more rows configured to interface with a circuit card plugged into a card slot of the card edge connector. The contacts typically include signal contacts and ground contacts providing electrical shielding for the signal contacts, such as between pairs of the signal contacts. However, as signal speeds increase, electrical shielding provided by the ground contacts may be insufficient.

A need remains for an electrical connector having an improved ground structure.

BRIEF DESCRIPTION OF THE INVENTION

In one embodiment, a contact assembly for an electrical connector is provided and includes an array of contacts including signal contacts and ground contacts. The signal contacts are arranged in pairs. The ground contacts are interspersed with the pairs of the signal contacts to provide electrical shielding between corresponding pairs of the signal contacts. Each signal contact includes a signal contact body having a first side and a second side opposite the first side. The signal contact body includes a signal mating end and a signal terminating end. Each ground contact includes a ground contact body having a first side and a second side opposite the first side. The ground contact body includes a ground mating end and a ground terminating end. The contact assembly includes a ground shield assembly including a ground shield and ground connective elements. The ground shield spans across the array of contacts. The ground connective elements are electrically connected to the ground shield. The ground connective elements are electrically connected to the corresponding ground contacts. The ground connective elements are compressible.

In another embodiment, a contact assembly for an electrical connector is provided and includes an array of contacts including signal contacts and ground contacts. The signal contacts are arranged in pairs. The ground contacts are interspersed with the pairs of the signal contacts to provide electrical shielding between corresponding pairs of the signal contacts. Each signal contact includes a signal contact body having a first side and a second side opposite the first side. The signal contact body includes a signal mating end and a signal terminating end. Each ground contact includes a ground contact body having a first side and a second side opposite the first side. The ground contact body includes a ground mating end and a ground terminating end. The contact assembly includes a ground shield assembly including a ground shield spanning across the array of contacts and an anisotropic conductive film between the ground shield and the ground contacts. The anisotropic conductive film forms ground connective elements. The ground connective elements electrically connected to the ground shield. The ground connective elements are electrically connected to the corresponding ground contacts.

In a further embodiment, a contact assembly for an electrical connector is provided and includes an array of contacts including signal contacts and ground contacts. The signal contacts are arranged in pairs. The ground contacts are interspersed with the pairs of the signal contacts to provide electrical shielding between corresponding pairs of the signal contacts. Each signal contact includes a signal contact body having a first side and a second side opposite the first side. The signal contact body includes a signal mating end and a signal terminating end. Each ground contact includes a ground contact body having a first side and a second side opposite the first side. The ground contact body includes a ground mating end and a ground terminating end. The contact assembly includes a ground shield assembly including a ground shield, ground connective elements, and a flexible circuit. The ground shield spans across the array of contacts. The ground connective elements are electrically connected to the ground shield. The ground connective elements are electrically connected to the corresponding ground contacts. The flexible circuit includes resistive bridges between the signal contacts and the ground contacts.

DETAILED DESCRIPTION OF THE INVENTION

Figure 1:
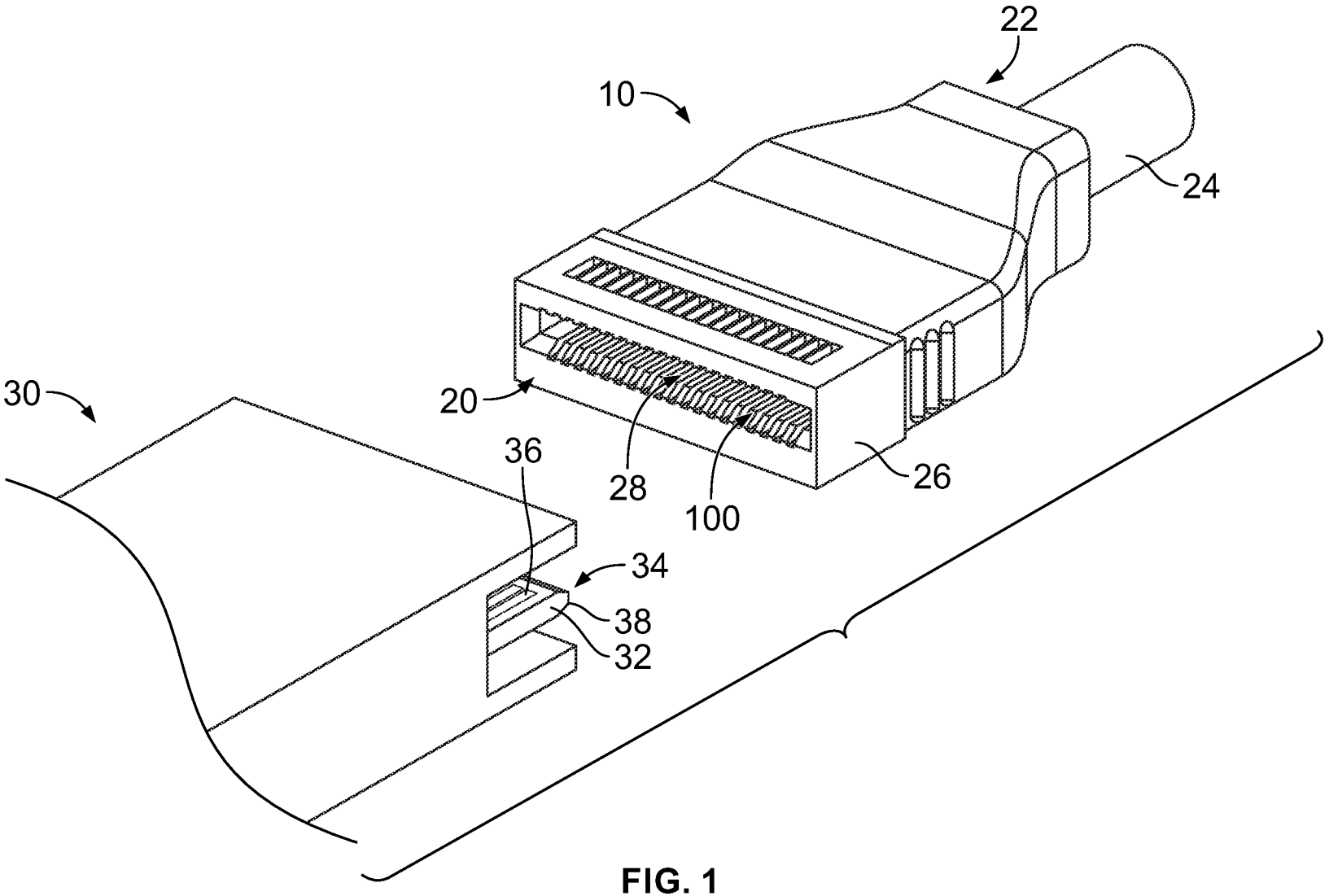
FIG. 1 is a perspective view of an electrical connector formed in accordance with one embodiment.

FIG. 1 is a perspective view of an electrical connector 10 formed in accordance with one embodiment. The electrical connector 10 is configured to be mated with a mating electrical connector 30. In an exemplary embodiment, the electrical connector 10 has a mating end 20, a cable end 22, and one or more cables 24 extending from the cable end 22. The electrical connector 10 includes a housing 26 configured to hold a contact assembly 100. In an exemplary embodiment, the housing 26 includes a card slot 28 at the mating end 20. In the illustrated embodiment, the electrical connector 10 is a communication device, such as a serial attached SCSI (SAS) connector. However, the electrical connector 10 may be another type of electrical connector in an alternative embodiment. For example, the electrical connector 10 may define a socket or receptacle connector, such as a card edge socket connector.

The mating electrical connector 30 is configured to be mated with the electrical connector 10. In an exemplary embodiment, the mating electrical connector 30 has a circuit card 32 at a mating end 34 of the mating electrical connector 30. The circuit card 32 includes mating contacts 36 at a card edge 38 of the circuit card 32. The mating contacts 36 may be provided at both sides of the circuit card 32. The connectors 10, 30 may be a high-speed connectors that transmit data signals at speeds over 10 gigabits per second (Gbps), such as over 25 Gbps. The connectors 10, 30 may be input-output (I/O) connectors.

Figure 2:
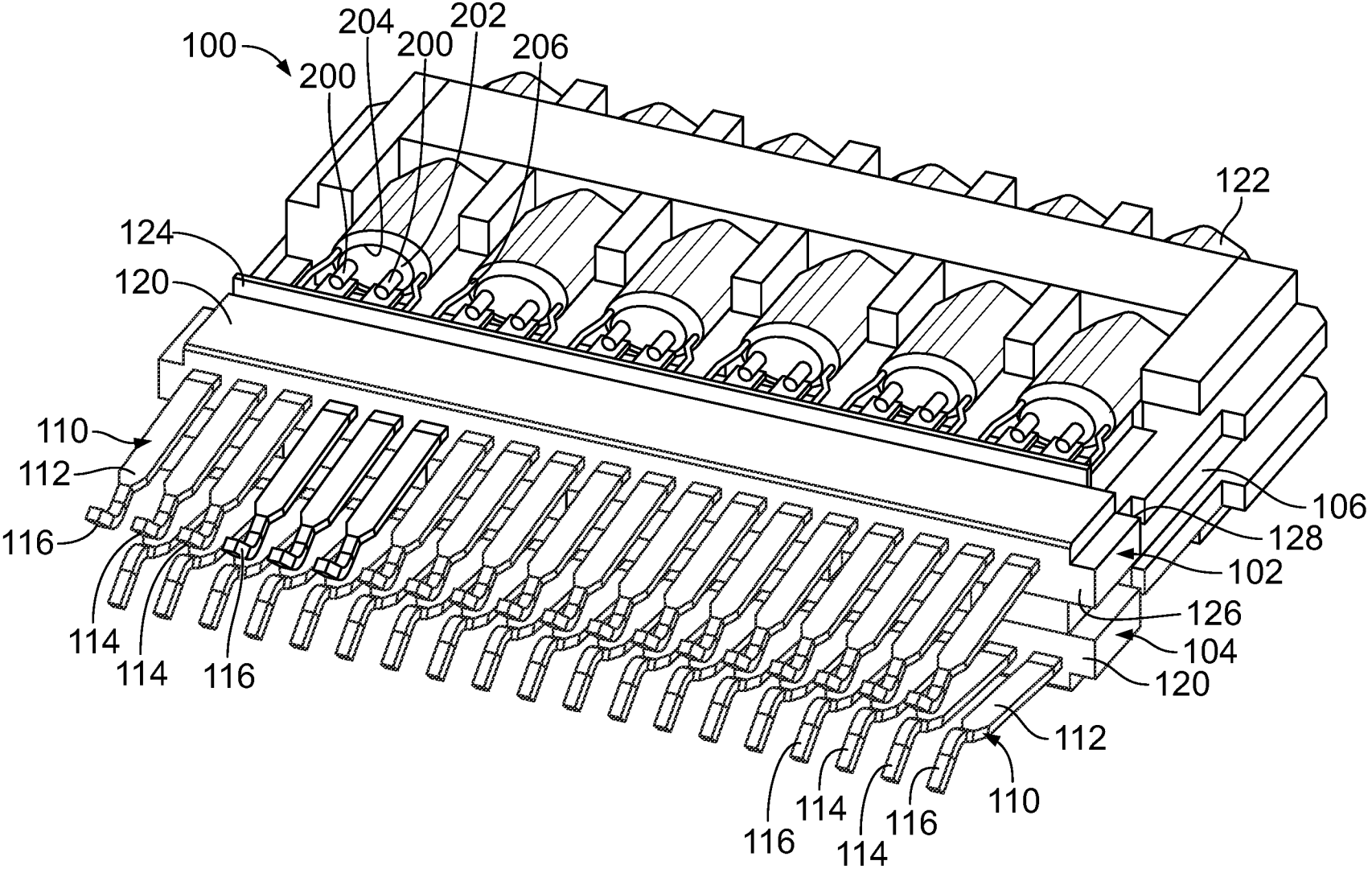
FIG. 2 is a perspective view of the contact assembly formed in accordance with one embodiment.

FIG. 2 is a perspective view of the contact assembly 100 formed in accordance with one embodiment. In an exemplary embodiment, the contact assembly 100 includes an upper contact subassembly 102 and a lower contact subassembly 104 coupled to a frame 106. The frame 106 supports the upper and lower contact subassemblies 102, 104. Optionally, the upper and lower contact subassemblies 102, 104 may be identical to each other and inverted 180°. In alternative embodiments, the contact assembly 100 may be provided without the frame 106, rather having the upper and lower contact assemblies coupled directly to each other without an intervening supporting structure. In other alternative embodiments, the contact assembly 100 may be provided with a single contact subassembly, such as provided without the lower contact subassembly 104.

The description herein may be made specifically to the "upper" contact subassembly 102 with the qualifier "upper" and may be made specifically to the "lower" contact subassembly 104 with the qualifier "lower" or may be made generically to the upper or the lower contact subassemblies 102, 104 without use of the qualifiers "upper" or "lower".

The contact assembly 100 includes a leadframe 110 having an array of contacts 112 including signal contacts 114 and ground contacts 116. The contact assembly 100 includes a contact holder 120 holding the array of contacts 112. The contact assembly 100 includes cables 122 terminated to the leadframe 110. The contact assembly 100 includes a ground bus 124 provided to electrically common the ground contacts 116 and the cables 122. In an alternative embodiment, rather than being a cabled contact assembly, the contact assembly 100 may be configured to be terminated to a circuit board, such as being soldered or press-fit to the circuit board.

In an exemplary embodiment, the cables 122 are twinaxial cables. Each cable 122 includes a pair of signal conductors 200 arranged in an insulator 202. A cable shield 204 surrounds the insulator 202 to provide electrical shielding for the signal conductors 200. The cable 122 includes one or more drain wires 206 electrically connected to the cable shield 204. Other types of cables 122 may be used in alternative embodiments, such as coaxial cables.

The contact holder 120 is used to hold the contacts 112, including the signal contacts 114 and the ground contacts 116. The contact holder 120 is manufactured from a dielectric material to electrically isolate the contacts 112 from each other. In an exemplary embodiment, the contact holder 120 is overmolded over the leadframe 110 to encase portions of the contacts 112 and hold relative positions of the contacts 112. The contact holder 120 extends between a front 126 and a rear 128.

In an exemplary embodiment, the contacts 112 are arranged in one or more rows. For example, the upper contacts 112 are arranged in an upper row configured to interface with an upper surface of a circuit card, such as the circuit card 32, and the lower contacts 112 are arranged in a lower row configured to interface with a lower surface of the circuit card 32. In an exemplary embodiment, the signal contacts 114 are arranged in pairs, such as differential pairs. The ground contacts 116 are interspersed between the signal contacts 114, such as between the pairs of the signal contacts 114, to provide electrical shielding between the corresponding signal contacts 114.

Figure 3:
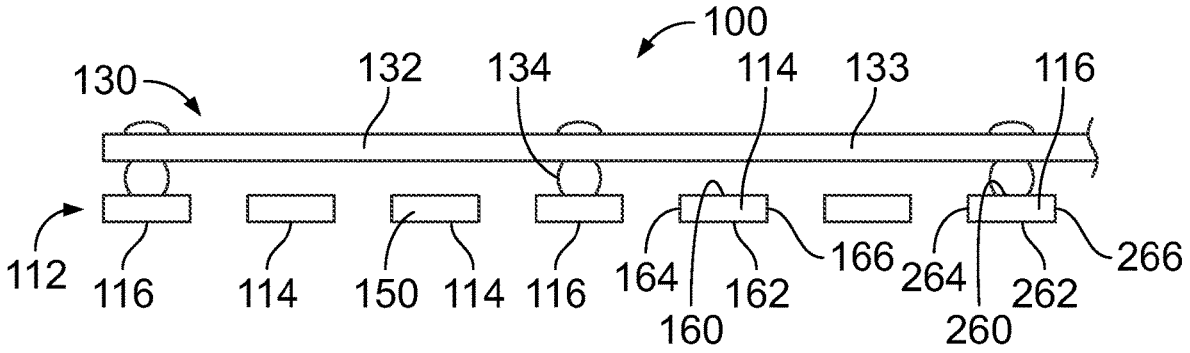
FIG. 3 is an end view of a portion of the contact array showing the signal contacts and the ground contacts in accordance with an exemplary embodiment.

FIG. 3 is an end view of a portion of the contact array 112 showing the signal contacts 114 and the ground contacts 116 in accordance with an exemplary embodiment. The signal contacts 114 are arranged in pairs with the ground contacts 116 interspersed between the pairs of the signal contacts 114. The contact assembly 100 includes a ground shield assembly 130 providing electrical shielding for the contact assembly 100. The ground shield assembly 130 provides electrical isolation between the signal transmission paths. For example, the ground shield assembly 130 may provide improved inter-pair isolation and/or intra-pair isolation. The ground shield assembly 130 may reduce cross-talk. The ground shield assembly 130 improves electrical performance of the contact assembly 100. In an exemplary embodiment, the ground shield assembly 130 may be directly electrically connected to the ground contacts 116. The ground shield assembly 130 may be capacitively or inductively coupled to the signal contacts 114. In various embodiments, the ground shield assembly 130 may include resistive elements, such as resistive bridges between the ground shield assembly 130 and the signal contacts 114.

Figure 4:
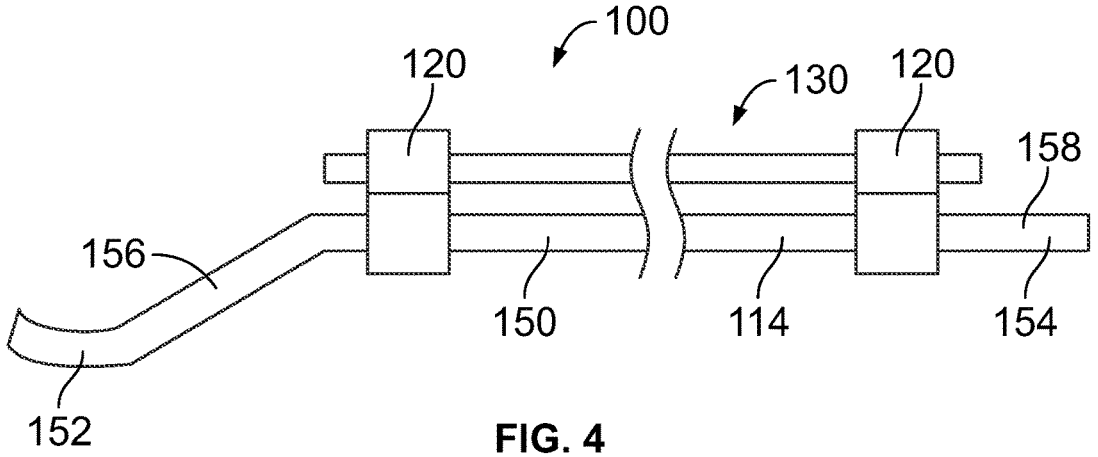
FIG. 4 is a side view of the signal contact in accordance with an exemplary embodiment.

With additional reference to FIG. 4, a side view is shown of the signal contact 114 showing the ground shield assembly 130 relative to the signal contact 114 in accordance with an exemplary embodiment. Each signal contact 114 includes a signal contact body 150 extending between a signal mating end 152 and a signal terminating end 154. The contact holder 120 holds the signal contact bodies 150 relative to each other. The contact holder 120 maintains spacing between the signal contacts 114. The signal mating ends 152 are located forward of the contact holder 120. The signal terminating ends 154 are located rearward of the contact holder 120. In an exemplary embodiment, multiple contact holders are provided along the lengths of the signal contacts 114, such as proximate to the signal mating ends 152 and proximate to the signal terminating ends 154.

In an exemplary embodiment, the signal contacts 114 include spring beams 156 at the signal mating ends 152. The spring beams 156 are deflectable spring beams. The spring beams 156 are configured to be coupled to the circuit card 32 (shown in FIG. 1). The spring beams 156 are bent out of plane with respect to the main portions of the signal contact bodies 150. For example, the spring beams 156 may be bent at an angle downward (or upward) to interface with the circuit card 32. The spring beams 156 may be elastically deformed (for example, pushed upward (or downward) when mated with the circuit card 32, which creates an internal biasing force (spring force) maintaining mechanical and electrical connection with the circuit card 32.

In an exemplary embodiment, the signal contacts 114 include pads 158 at the signal terminating ends 154. The pads 158 are configured to be welded or soldered to the signal conductors 200 of the cables 122. The pads 158 may be bent out of plane with respect to the main portions of the signal contact bodies 150. The signal terminating ends 154 may include other connection means in alternative embodiments, such as crimp barrels, insulating displacement features, and the like for electrical connection to the signal conductors 200. In alternative embodiments, the signal terminating ends 154 may include terminating features for terminating the signal contacts 114 to a circuit board, such as solder tails or press-fit pins. Optionally, the signal contact body 150 may be right angle contacts including a transition (for example, one or more bends) to orient the signal terminating ends 154 perpendicular to the signal mating ends 152.

In an exemplary embodiment, the signal contact 114 is a stamped and formed contact. The signal contact body 150 is stamped from a metal sheet or blank. The signal contact body 150 includes a first side 160 and a second side 162 opposite the first side 160. The second side 162 is an inner side facing the circuit card 32 and the first side 160 is an outer side facing away from the circuit card 32. The signal contact body 150 includes a first edge 164 between the first and second sides 160, 162 and a second edge 166 between the first and second sides 160, 162. The second edge 166 is opposite the first edge 164. The edges 164, 166 face each other and/or edges of the ground contacts 116. In an exemplary embodiment, the signal contact body 150 has a rectangular cross-section. The sides 160, 162 may be wider than the edges 164, 166. The edges 164, 166 may be the cut edges formed during the stamping process.

Figure 5:
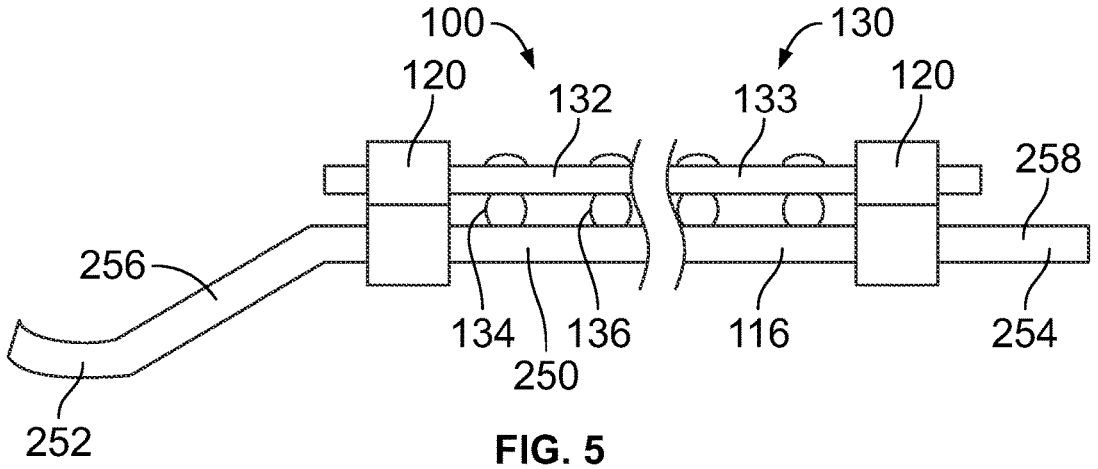
FIG. 5 is a side view of the ground contact in accordance with an exemplary embodiment.

With reference to FIG. 3 and additional reference to FIG. 5, which is a side view of the ground contact 116, the ground shield assembly 130 is positioned relative to the ground contact 116 to electrically connect the ground shield assembly 130 with the ground contact 116. The ground shield assembly 130 is used to electrically common the ground contacts 116.

Each ground contact 116 includes a ground contact body 250 extending between a ground mating end 252 and a ground terminating end 254. The contact holder 120 holds the ground contact bodies 250 relative to each other and relative to the signal contact bodies 150. The ground mating ends 252 are located forward of the contact holder 120. The ground terminating ends 254 are located rearward of the contact holder 120. In an exemplary embodiment, multiple contact holders 120 are provided along the lengths of the ground contacts 116, such as proximate to the ground mating ends 252 and proximate to the ground terminating ends 254.

In an exemplary embodiment, the ground contacts 116 include spring beams 256 at the ground mating ends 252. The spring beams 256 are deflectable spring beams. The spring beams 256 are configured to be electrically connected to the circuit card 32. The spring beams 256 are bent out of plane with respect to the main portions of the ground contact bodies 250. For example, the spring beams 256 may be bent at an angle downward (or upward) to interface with the circuit card 32. The spring beams 256 may be elastically deformed (for example, pushed upward (or downward) when mated with the circuit card 32, which creates an internal biasing force (spring force) maintaining mechanical and electrical connection with the circuit card 32.

In an exemplary embodiment, the ground contacts 116 include pads 258 at the ground terminating ends 254. The pads 258 are configured to be welded or soldered to the drain wires 206 or cable shields 204 of the cables 122 to electrically common the cables 122 and the leadframe 110. The pads 258 may be bent out of plane with respect to the main portions of the ground contact bodies 250. In alternative embodiments, the ground terminating ends 254 may include terminating features for terminating the ground contacts 116 to a circuit board, such as solder tails or press-fit pins. Optionally, the ground contact body 250 may be right angle contacts including a transition (for example, one or more bends) to orient the ground terminating ends 254 perpendicular to the ground mating ends 252.

In an exemplary embodiment, the ground contact 116 is a stamped and formed contact. The ground contact body 250 is stamped from a metal sheet or blank, and may be stamped with the signal contact bodies 150 to form the leadframe. The ground contact body 250 may be formed identical to the signal contact body 150. The ground contact body 250 includes a first side 260 and a second side 262 opposite the first side 260. The ground contact body 250 includes a first edge 264 between the first and second sides 260, 262 and a second edge 266 between the first and second sides 260, 262. The second edge 266 is opposite the first edge 264. The second side 262 is an inner side facing the circuit card 32 and the first side 260 is an outer side facing away from the circuit card 32. The ground contact body 250 includes a first edge 264 between the first and second sides 260, 262 and a second edge 266 between the first and second sides 260, 262. The second edge 266 is opposite the first edge 264. The edges 264, 266 face each other and/or edges 164, 166 of the signal contacts 114.

In an exemplary embodiment, the ground shield assembly 130 includes a ground shield 132 and ground connective elements 134. The ground connective elements 134 are electrically connected to the ground shield 132. The ground connective elements 134 are electrically connected to the ground contacts 116. The ground connective elements 134 electrically connect the ground contacts 116 with the ground shield 132. The ground connective elements 134 may use pressure to create a conductive path in the Z-axis between the ground contacts 116 and the ground shield 132. The ground shield 132 may be used to electrically common the ground contacts 116. Optionally, the ground connective elements 134 may be coupled to the corresponding ground contacts 116 at spaced apart locations (for example, intervals) along the lengths of the ground contacts 116. The ground connective elements 134 provide multiple points of contact and commoning points between the ground shield 132 and the ground contacts 116.

The ground shield 132 spans across the array of contacts 112. The ground shield 132 may span the entire width of the contact assembly 100. The ground shield 132 extends lengthwise along the array of contacts 112, such as between the mating ends 152 and the terminating ends 154. The ground shield 132 may span a majority of the length of the array of contacts 112. Optionally, the ground shield 132 may span approximately the entire length of the array of contacts 112. The ground shield 132 provides shielding over (or under) the signal contacts 114, such as to shield the signal contacts 114 between the signal mating ends 152 and the signal terminating ends 154.

In an exemplary embodiment, the ground shield 132 includes a conductive plate 133. The conductive plate 133 may be a stamped and formed plate 133. The ground shield 132 may be another ground structure in alternative embodiments, such as a conductive substrate, a conductive film, a ground layer of a flex circuit, and the like. Optionally, the conductive plate 133 may be planar. Alternatively, the conductive plate may be contoured. For example, the conductive plate 133 may be positioned closer to the ground contacts 116 and further from the signal contacts 114 or vice versa. The conductive plate 133 may be positioned closer to the ground contacts 116 at some locations compared to at other locations (for example, proximate to the ground mating ends 252 and/or the ground terminating ends 254 or at the ground connective element locations). The conductive plate 133 may be positioned closer to the signal contacts 114 at some locations compared to at other locations (for example, proximate to the signal mating ends 152 and/or the signal terminating ends 154). In the illustrated embodiment, the conductive plate 133 is spaced apart from the first sides 160 of the signal contact bodies 150 and spaced apart from the first sides 260 of the ground contact bodies 250. The ground connective elements 134 span between the first sides 260 of the ground contact bodies 250 and the conductive plate 133.

In an exemplary embodiment, the contact holder 120 is mechanically coupled to the ground shield 132. The contact holder 120 is additionally mechanically coupled to the ground contact bodies 250 to hold the ground shield 132 relative to the ground contacts 116. In an exemplary embodiment, the contact holder 120 compresses the ground connective elements 134 between the ground shield 132 and the ground contact bodies 250. For example, the contact holder 120 holds the ground shield 132 at a height above the ground contacts 116 that is less than a natural or formed height of the ground connective elements 134 thus compressing the ground connective elements 134 and maintaining the electrical connection between the ground connective elements 134 and the ground shield 132. The contact assembly 100 may use other fixturing or holding devices to maintain positive pressure or force on the ground connective elements 134 to maintain the conductive pathway through the ground connective elements 134.

In an exemplary embodiment, as in the embodiment illustrated in FIG. 5, the ground connective elements 134 are conductive elastomeric columns 136. For example, the ground connective elements 134 may be columnar-shaped molded structures, which may be molded from a conductive polymer material (polymer matrix with conductive flakes or particles, such as silver particles) or may be molded from a polymer material having a conductive coating, such as a conductive plating around the exterior of the structure. The ground connective elements 134 may be conductive polymer buttons. The ground connective elements 134 are compressible. Optionally, compression of the ground connective elements 134 may activate or increase the conductivity of the columns 136. The ground shield 132 is electrically connected to the ground contacts 116 through the conductive elastomeric columns 136. For example, the conductive elastomeric columns 136 are positioned at predetermined intervals along the length of the ground contact bodies 250 between the ground mating ends 252 and the ground terminating ends 254 to provide grounding paths between the ground shield 132 and the ground contacts 116.

Figure 6:
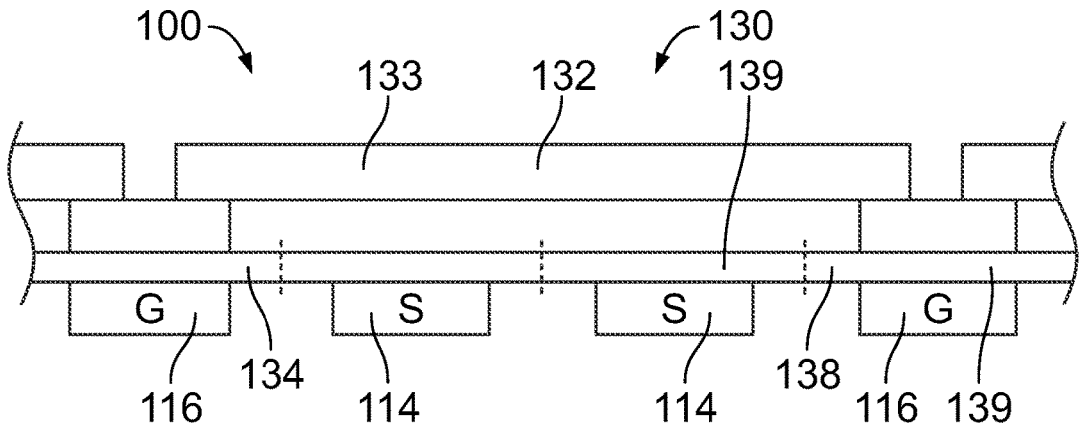
FIG. 6 is an end view of a portion of the contact assembly in accordance with an exemplary embodiment.
Figure 7:
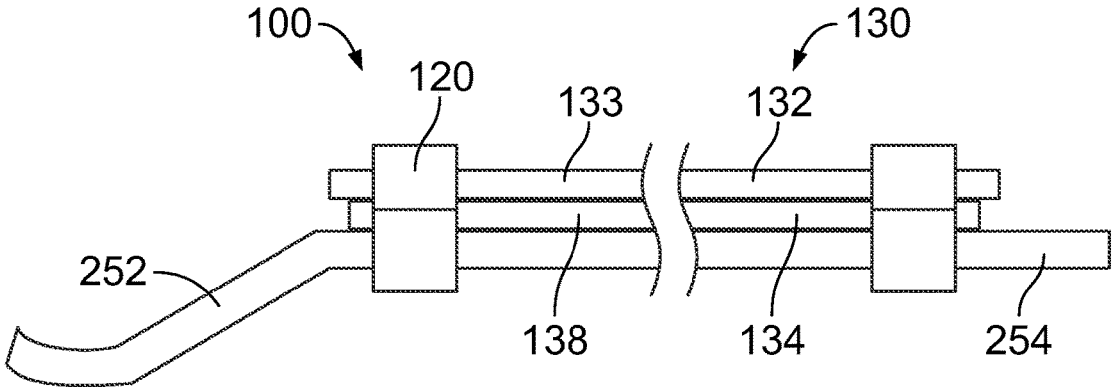
FIG. 7 is a side view of a portion of the contact assembly in accordance with an exemplary embodiment.

FIG. 6 is an end view of a portion of the contact assembly 100 in accordance with an exemplary embodiment. FIG. 7 is a side view of a portion of the contact assembly 100 in accordance with an exemplary embodiment. The contact assembly 100 includes the ground shield assembly 130 providing electrical shielding for the contact assembly 100. The ground shield assembly 130 includes the ground shield 132 and the ground connective elements 134. The ground shield 132 may include the conductive plate 133 (for example, stamped and formed plate); however, the ground shield 132 may be another ground structure in alternative embodiments, such as a conductive substrate, a conductive film, a ground layer of a flex circuit, and the like.

In an exemplary embodiment, the ground connective elements 134 include one or more anisotropic conductive films 138. For example, the ground connective elements 134 may be defined by a single anisotropic conductive film 138, which is segmented or cut into individual film elements 139. The film elements 139 cover the ground contacts 116 and may additionally cover the signal contacts 114; however, the anisotropic conductive film 138 may be removed over the signal contacts 114 in alternative embodiments. The anisotropic conductive film 138 is segmented to isolate the ground portions from the signal portions.

The anisotropic conductive films 138 are electrically connected to the ground shield 132. The anisotropic conductive films 138 are electrically connected to the ground contacts 116. The anisotropic conductive films 138 electrically connect the ground contacts 116 with the ground shield 132. The anisotropic conductive film 138 uses pressure and heat to create a conductive path in the Z-axis between the ground contacts 116 and the ground shield 132. The anisotropic conductive film 138 provides a low impedance interface between the ground contacts 116 and the ground shield 132.

Optionally, the anisotropic conductive films 138 may extend substantially the entire lengths of the ground contacts 116, such as from the ground mating ends 252 to the ground terminating ends 254. As such, the anisotropic conductive films 138 provide continuous conductive paths between the ground shield 132 and the ground contacts 116. In an exemplary embodiment, the contact assembly 100 uses a fixture or holder to maintain positive pressure or force on the anisotropic conductive film 138 to maintain the conductive pathway through the anisotropic conductive film 138.

The contact holder 120 is mechanically coupled to the ground shield 132. The contact holder 120 is additionally mechanically coupled to the anisotropic conductive films 138 and/or the ground contact bodies 250 to hold the ground shield 132 relative to the anisotropic conductive films 138 and the ground contacts 116. In an exemplary embodiment, the contact holder 120 compresses the anisotropic conductive films 138 between the ground shield 132 and the ground contact bodies 260. The contact assembly 100 may use other fixturing or holding devices to maintain positive pressure or force on the ground connective elements 134 to maintain the conductive pathway through the ground connective elements 134.

The ground shield assembly 130, through the anisotropic conductive films 138 and the ground shield 132, provides electrical isolation between the signal transmission paths. For example, the ground shield assembly 130 may provide improved inter-pair isolation and/or intra-pair isolation. The ground shield assembly 130 may reduce cross-talk. The ground shield assembly 130 improves electrical performance of the contact assembly 100. In an exemplary embodiment, the ground shield assembly 130 may be directly electrically connected to the ground contacts 116. The ground shield assembly 130 may be capacitively or inductively coupled to the signal contacts 114. In various embodiments, the ground shield assembly 130 may include resistive elements, such as resistive bridges between the ground shield assembly 130 and the signal contacts 114.

Figure 8:
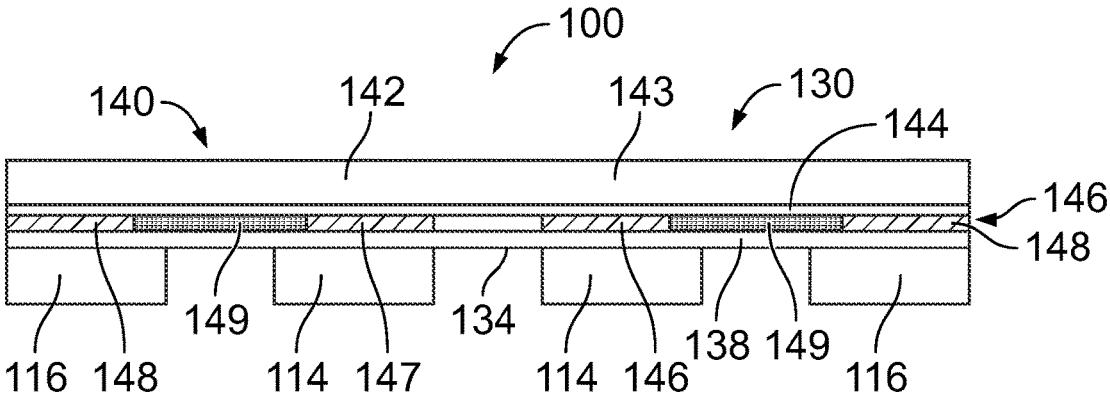
FIG. 8 is an end view of a portion of the contact assembly in accordance with an exemplary embodiment, through the spring beams of the signal and ground contacts.
Figure 9:
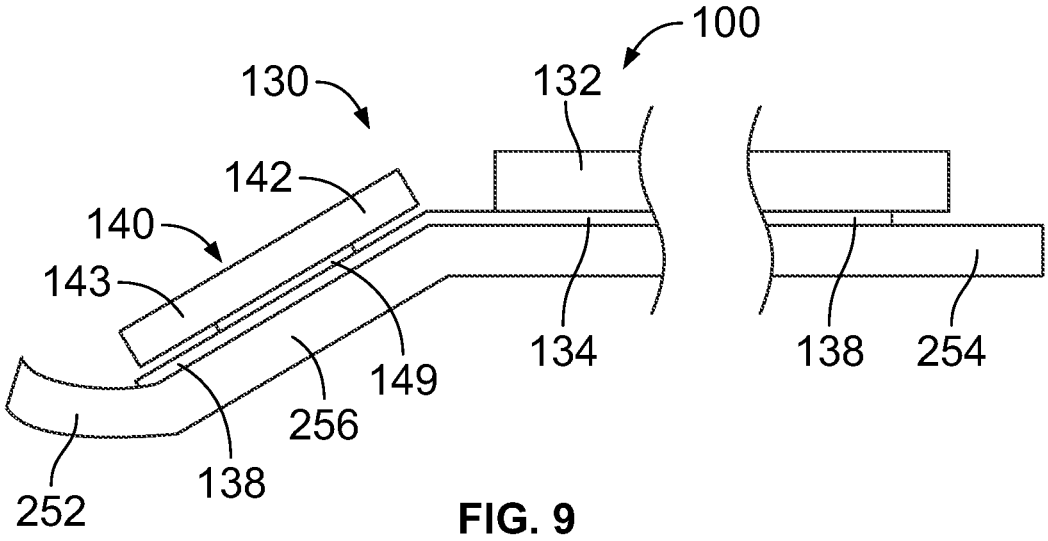
FIG. 9 is a side view of a portion of the contact assembly in accordance with an exemplary embodiment.

FIG. 8 is an end view of a portion of the contact assembly 100 in accordance with an exemplary embodiment, through the spring beams 156, 256 of the signal and ground contacts 114, 116. FIG. 9 is a side view of a portion of the contact assembly 100 in accordance with an exemplary embodiment. The contact assembly 100 includes the ground shield assembly 130 providing electrical shielding for the contact assembly 100. The ground shield assembly 130 includes the ground shield 132 and the ground connective elements 134. In an exemplary embodiment, the ground shield assembly 130 includes an impedance control element 140 at the mating end of the contact assembly 100. The impedance control element 140 is provided at the spring beams 156, 256 of the signal and ground contacts 114, 116. The impedance control element 140 is located forward of the ground shield 132.

The impedance control element 140 includes a flexible circuit 142 having a ground layer 144. The flexible circuit 142 includes a substrate 143. The substrate is flexible. In an exemplary embodiment, the substrate 143 is a tape or film. The substrate 143 may be a polyimide film. Optionally, the substrate 143 may have multiple layers. The substrate 143 is flexible to allow the substrate 143 to move with the contacts 114, 116. The substrate 143 is flexible to allow the substrate to conform to the shape of the contacts 114, 116, such as the spring beams 156, 256 (for example, to follow along bends in the spring beams 156, 256).

The ground layer 144 may form a portion of the ground shield 132. For example, the ground layer 144 may form the portion of the ground shield 132 providing shielding for the spring beams 156, 256. The ground layer 144 may be separate from the main portion of the ground shield 132. For example, the ground shield 132 may include the stamped and formed plate covering the majority of the contacts while the ground layer 144 covers the spring beams 156, 256. In alternative embodiments, the flexible circuit 142 may form the entirety of the ground shield 132. For example, the flexible circuit 142 may extend between the mating ends 152, 252 and the terminating ends 154, 254 of the contacts 114, 116, such as a majority of the lengths of the contacts 114, 116 or substantially the entire lengths of the contacts 114, 116.

In an exemplary embodiment, the flexible circuit 142 includes circuits 146 on the substrate 143. The circuits 146 include conductors, such as signal conductors 147 and ground conductors 148 associated with the signal contacts 114 and the ground contacts 116, respectively. The signal conductors 147 may be electrically connected to the signal contacts 114 (for example, the spring beams 156) and the ground conductors 148 may be electrically connected to the ground contacts 116 (for example, the spring beams 256). In an exemplary embodiment, the signal conductors 147 are electrically connected to the signal contacts 114 through the connective elements 134 (for example, the anisotropic conductive films 138) and the ground conductors 148 are electrically connected to the ground contacts 116 through the connective elements 134 (for example, the anisotropic conductive films 138). In an exemplary embodiment, the circuits 146 include resistive bridges 149 between the signal contacts 114 and the ground contacts 116, such as between the signal conductors 147 and the ground conductors 148. The resistive bridges 149 provide a shunt between the signal contacts 114 and the ground contacts 116 close to the mating interfaces. The resistive bridges 149 provide impedance control along the contacts 114, 116, such as at the mating ends 152, 252. The resistive bridges 149 may be designed to control impedance to a target impedance, such as 100 Ohms, 85 Ohms, and the like. In an exemplary embodiment, the impedance control is provided along the spring beams 156, 256. In various embodiments, the resistive bridges 149 are film resistors, such as polymer thick film resistors. Other types of resistors may be used in alternative embodiments, such as carbon resistive elements. The resistive bridges 149 may be variable resistors.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A contact assembly for an electrical connector comprising:

an array of contacts including signal contacts and ground contacts, the signal contacts arranged in pairs, the ground contacts interspersed with the pairs of the signal contacts to provide electrical shielding between corresponding pairs of the signal contacts, each signal contact including a signal contact body having a first side and a second side opposite the first side, the signal contact body including a signal mating end and a signal terminating end, each ground contact including a ground contact body having a first side and a second side opposite the first side, the ground contact body including a ground mating end and a ground terminating end; and a ground shield assembly including a ground shield and ground connective elements, the ground shield spanning across the array of contacts, the ground connective elements electrically connected to the ground shield, the ground connective elements electrically connected to the corresponding ground contacts, the ground connective elements being compressible, the ground shield assembly including an impedance control element extending along the ground mating ends of the ground contacts to provide impedance control for the array of contacts.

2. The contact assembly of claim 1, wherein the ground connective elements include conductive elastomeric columns.

3. The contact assembly of claim 1, wherein the ground connective elements are positioned at predetermined intervals along the length of the ground contact body between the ground mating end and the ground terminating end.

4. The contact assembly of claim 1, wherein the ground shield includes a conductive plate spaced apart from the first sides of the signal contact bodies and spaced apart from the first sides of the ground contact bodies, the ground connective elements spanning between the first sides of the ground contact bodies and the conductive plate.

5. The contact assembly of claim 1, further comprising a contact holder mechanically coupled to the ground shield and the ground contact bodies, the contact holder holding the ground shield relative to the ground contacts, the contact holder compressing the ground connective elements between the ground shield and the ground contact bodies.

6. The contact assembly of claim 1, wherein the ground connective elements include an anisotropic conductive film between the ground shield and the ground contacts.

7. The contact assembly of claim 6, wherein the anisotropic conductive film extends across the signal contacts between the ground contacts.

8. The contact assembly of claim 6, wherein the anisotropic conductive film includes ground portions engaging the ground contacts and signal portions engaging the signal contacts, the anisotropic conductive film including openings between the ground portions and the signal portions to isolate the ground portions from the signal portions.

9. The contact assembly of claim 1, wherein the ground shield assembly includes a flexible circuit, the flexible circuit including a ground layer forming the ground shield.

10. The contact assembly of claim 9, wherein the flexible circuit includes resistive bridges between the signal contacts and the ground contacts.

11. The contact assembly of claim 10, wherein each resistive bridge includes a polymer thick film resistor.

12. A contact assembly for an electrical connector comprising:

an array of contacts including signal contacts and ground contacts, the signal contacts arranged in pairs, the ground contacts interspersed with the pairs of the signal contacts to provide electrical shielding between corresponding pairs of the signal contacts, each signal contact including a signal contact body having a first side and a second side opposite the first side, the signal contact body including a signal mating end and a signal terminating end, each ground contact including a ground contact body having a first side and a second side opposite the first side, the ground contact body including a ground mating end and a ground terminating end; and a ground shield assembly including a ground shield spanning across the array of contacts and an anisotropic conductive film between the ground shield and the ground contacts, the anisotropic conductive film forming ground connective elements, the ground connective elements electrically connected to the ground shield, the ground connective elements electrically connected to the corresponding ground contacts, wherein the anisotropic conductive film includes ground portions engaging the ground contacts and signal portions engaging the signal contacts, the anisotropic conductive film including openings between the ground portions and the signal portions to isolate the ground portions from the signal portions.

13. The contact assembly of claim 12, wherein the ground shield includes a conductive plate spaced apart from the first sides of the signal contact bodies and spaced apart from the first sides of the ground contact bodies, the ground connective elements spanning between the first sides of the ground contact bodies and the conductive plate.

14. The contact assembly of claim 12, wherein the anisotropic conductive film extends across the signal contacts between the ground contacts.

15. The contact assembly of claim 12, wherein the ground shield assembly includes a flexible circuit, the flexible circuit including resistive bridges between the signal contacts and the ground contacts.

16. A contact assembly for an electrical connector comprising:

an array of contacts including signal contacts and ground contacts, the signal contacts arranged in pairs, the ground contacts interspersed with the pairs of the signal contacts to provide electrical shielding between corresponding pairs of the signal contacts, each signal contact including a signal contact body having a first side and a second side opposite the first side, the signal contact body including a signal mating end and a signal terminating end, each ground contact including a ground contact body having a first side and a second side opposite the first side, the ground contact body including a ground mating end and a ground terminating end; and a ground shield assembly including a ground shield, ground connective elements, and a flexible circuit, the ground shield spanning across the array of contacts, the ground connective elements electrically connected to the ground shield, the ground connective elements electrically connected to the corresponding ground contacts, the flexible circuit including resistive bridges between the signal contacts and the ground contacts.

17. The contact assembly of claim 16, wherein the flexible circuit includes a ground layer forming the ground shield.

18. The contact assembly of claim 16, wherein the signal contacts include spring beams at the signal mating ends and the ground contacts includes spring beams at the ground mating ends, the resistive bridges being provided along the spring beams of the signal contacts and the spring beams of the ground contacts.

19. The contact assembly of claim 16, wherein the ground connective elements include an anisotropic conductive film between the flexible circuit and the ground contacts.

20. The contact assembly of claim 1, wherein the impedance control element is located forward of the ground shield.

21. The contact assembly of claim 1, wherein the signal mating ends include spring beams and the ground mating ends include spring beams, the impedance control element extending along the spring beams of the signal mating ends and the ground mating ends.

22. The contact assembly of claim 1, wherein the impedance control element includes a flexible circuit having a ground layer.

* * * * *